US006595862B2

(12) United States Patent
Porper

(10) Patent No.: US 6,595,862 B2
(45) Date of Patent: Jul. 22, 2003

(54) BILLIARDS BALL RACK

(75) Inventor: Joseph Porper, Chatsworth, CA (US)

(73) Assignee: Creative Inventions, Chatsworth, CA (US)

( * ) Notice: Subject to any disclaimer, the term of this patent is extended or adjusted under 35 U.S.C. 154(b) by 0 days.

(21) Appl. No.: 09/827,541

(22) Filed: Apr. 6, 2001

(65) Prior Publication Data

US 2002/0107076 A1 Aug. 8, 2002

Related U.S. Application Data

(63) Continuation-in-part of application No. 29/137,008, filed on Feb. 8, 2001.

(51) Int. Cl.[7] ..... A63D 15/00; A63F 9/24
(52) U.S. Cl. ..... 473/40; 473/1
(58) Field of Search ..... 473/1, 2, 4, 21, 473/22, 26, 40, 41

(56) References Cited

U.S. PATENT DOCUMENTS

| | | | | | |
|---|---|---|---|---|---|
| 125,643 | A | | 4/1872 | Wilbur, Jr. | |
| 464,475 | A | | 12/1891 | Fisher | |
| 501,256 | A | * | 7/1893 | Rohrbach | 473/40 |
| 916,193 | A | | 3/1909 | Pierce | |
| 952,920 | A | * | 3/1910 | Meacham | 473/40 |
| 1,052,461 | A | | 2/1913 | Chase | |
| 1,089,140 | A | * | 3/1914 | Madigan | 473/40 |
| 1,187,243 | A | * | 6/1916 | Bernstein | 473/40 |
| 1,299,471 | A | * | 4/1919 | Hornbostel | 473/40 |
| 1,725,494 | A | * | 8/1929 | Varnum | 473/40 |
| 2,324,945 | A | | 7/1943 | Mistacu | |
| 2,405,677 | A | | 8/1946 | Volpe | |
| 2,422,939 | A | | 6/1947 | Volpe | |
| 2,469,652 | A | | 5/1949 | Jones | |
| D159,558 | S | | 8/1950 | Sundell | |
| 3,253,826 | A | | 5/1966 | Cook | |
| 3,423,087 | A | * | 1/1969 | Sowa | 473/40 |
| 3,672,671 | A | | 6/1972 | Merola | |
| 3,863,919 | A | | 2/1975 | Sardelli | |
| 3,992,005 | A | | 11/1976 | Richey | |
| 4,469,328 | A | | 9/1984 | Pacitti | |
| 4,553,750 | A | | 11/1985 | Kintz | |
| 4,903,965 | A | | 2/1990 | Smith | |
| 5,376,054 | A | | 12/1994 | Kwasny et al. | |
| 5,601,495 | A | | 2/1997 | Silverman | |
| 5,735,750 | A | | 4/1998 | Silverman | |
| 5,997,404 | A | | 12/1999 | Sardo | |

* cited by examiner

*Primary Examiner*—Paul T. Sewell
*Assistant Examiner*—Mitra Aryanpour
(74) *Attorney, Agent, or Firm*—Scott W. Kelley; Kelly Bauersfeld Lowry & Kelley, LLP

(57) ABSTRACT

A billiards ball rack includes a frame having a plurality of side walls forming an opening. A plate is attached to a top surface of the frame, and includes inwardly and downwardly directed inclined surfaces for engaging an outer periphery of a group of billiards balls to compact the billiards balls into a desired configuration. The inclined surfaces define a cut-out portion of the plate, typically a triangle or diamond. The rack includes lifting levers pivotally attached to two side walls of the triangular frame. When a handle segment of the lever is grasped and pulled upward, a lower foot segment pivots and extends below a base of the frame to lift the frame from the playing surface, leaving the compacted billiards balls in the desired configuration on the billiard table.

13 Claims, 4 Drawing Sheets

BILLIARDS BALL RACK

RELATED APPLICATION

This application is a continuation-in-part of U.S. Design patent application Ser. No. 29/137,008, filed Feb. 8, 2001.

BACKGROUND OF THE INVENTION

The present invention generally relates to the game of billiards. More particularly, the present invention relates to a billiards ball rack which compactly sets and arranges billiards balls on a billiards or pool table.

Billiards or pool games are extremely popular with people of all ages. In playing the game of pocket billiards, the balls are typically arranged on the surface of the billiards table via a racking frame. For the game commonly known as eight-ball, fifteen balls are placed within an independent triangular frame which is moved on the table until the balls are in a desired spot, after which the frame is removed leaving the balls on the table in a specific formation or "rack". The most common formation used in billiards is the triangular arrangement of the balls, but there are various other configurations used by billiards players, for example, a diamond arrangement used for the game of nine-ball.

When forming a pattern with frame racks, it is desirable to compact the balls into a tight group. This gives a truer "break" of the group of balls when they are struck by the cue ball. As a player's skill increases, the initial breakup of the rack may become an important opportunity for placing individual balls into definite locations on the table. The ability for such precise performance is dependent on the form and angle of the cue ball's contact with the racked balls. In order for the player to have such control, it is desired that the balls in the rack be as close together as possible. The optimal formation of the balls has every ball in direct contact with its neighboring balls.

Even with a skilled user, a tight pattern is not easily obtained using a simple frame or rack. This is due to the fact that the racks ordinarily used are sized to define an enclosure which is slightly larger than the group of balls. To tighten the ball formation, users sometimes touch the balls directly to urge the balls together. However, when the user removes his fingers from inside the rack, he will often inadvertently upset the pattern without knowing it due to a certain amount of adhesion between the user's fingers and the balls.

Devices have been proposed for the purpose of automatically racking billiards balls or assisting therewith. Unfortunately, these devices often have a complicated structure and are expensive in construction.

Accordingly, there is a need for a billiards ball rack which compactly arranges the billiards balls in the desired formation. Such a rack should not be complicated in construction, or expensive to manufacture. The present invention fulfills these needs and provides other related advantages.

SUMMARY OF THE INVENTION

The present invention relates to a -billiards ball rack which compactly arranges billiards balls on a billiards table for play. The rack generally comprises a frame having a plurality of side walls which form an opening, and a plate attached to a top surface of the frame having inwardly and downwardly directed inclined surfaces for engaging an outer periphery of a group of billiards balls to compact them into a desired configuration.

Typically the frame is triangular in shape. The inclined surfaces define a cut-out portion of the plate, and form the desired billiards ball configuration which may include a triangle or diamond.

Preferably, the billiards ball rack includes lifting levers which are pivotally attached to two side walls of the frame. The levers each include an upper handle segment which is configured to be manually grasped and pulled upward. The levers also include a lower foot segment. The levers are pivotally attached to the frame intermediate the handle and foot segments. When the upper handle segment is grasped and pulled upward, the foot segment extends below a base of the frame to lift the frame from the playing surface. A stop is typically associated with each lever for maintaining the handle segment in an elevated position with respect to the base of the frame. Preferably, each side wall of the frame having a lever includes two levers positioned generally opposite one another so that the foot segment of each lever pivots below a base of the frame and towards each other when the handle segment of each lever is manually pulled upward. This arrangement uniformly lifts the rack from the playing surface.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
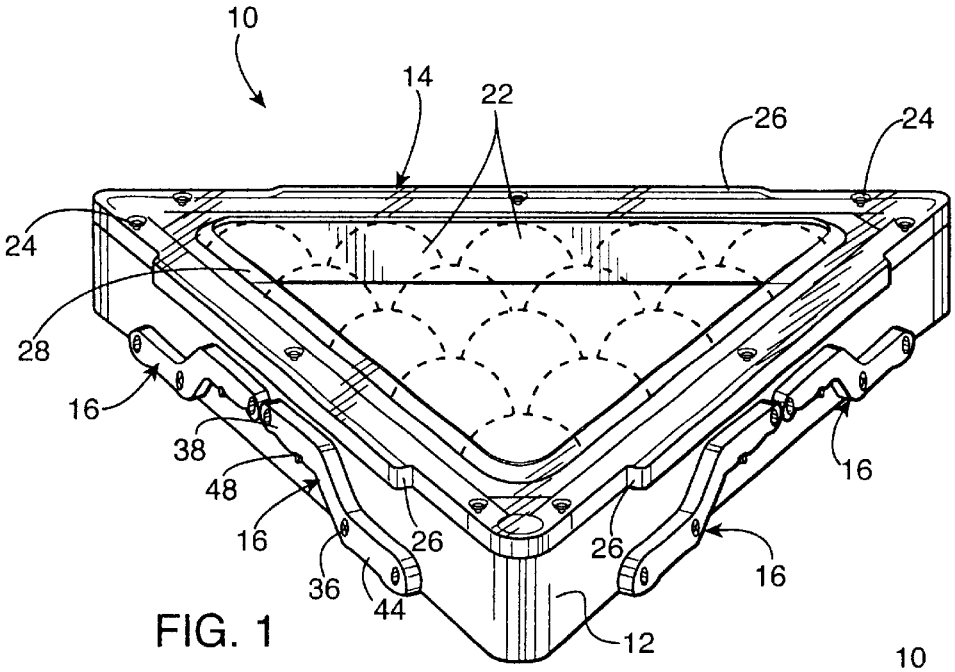
FIG. 1 is a perspective view of a billiards ball rack embodying the present invention, illustrating multiple billiards balls contained therein in phantom.

As shown in the drawings for purposes of illustration, the present invention is concerned with a billiards ball rack, generally referred to by the reference number 10. As illustrated in FIG. 1, the rack 10 includes a frame 12, a plate 14 attached to a top surface of the frame 12, and a plurality of levers 16 which use will be described more fully herein.

The frame 12 is typically triangular in shape and comprised of a sufficiently stiff and durable material, such as wood or plastic. In a triangular configuration, three side walls 18 define an inner enclosure 20 into which billiards balls 22 are placed for racking.

The plate 14 is attached to a generally planar top surface of the frame with screws 24, adhesives, or any other appropriate securement means. The plate 14 has an outer periphery which is generally triangular so as to generally coincide with the frame 12. However, the outer periphery of the plate 14 preferably includes overhanging portions 26 which can be cooperatively used with levers 16 to lift the rack 10, as will be described more fully herein.

The plate at least partially covers the frame enclosure 20, and within this portion are formed inwardly and downwardly directed inclined surfaces 28 which serve to engage an outer periphery of the billiards balls 22 to compact them into a desired configuration. Thus, the inclined surfaces 28 can be arranged to form a triangle, as illustrated in the accompanying drawings, or a diamond (not shown) to compact the billiards balls 22 to the desired configuration depending upon the game intended to be played. For example, when playing eight-ball, the fifteen billiards balls 22 are arranged into a triangular configuration, as illustrated.

Figure 2:
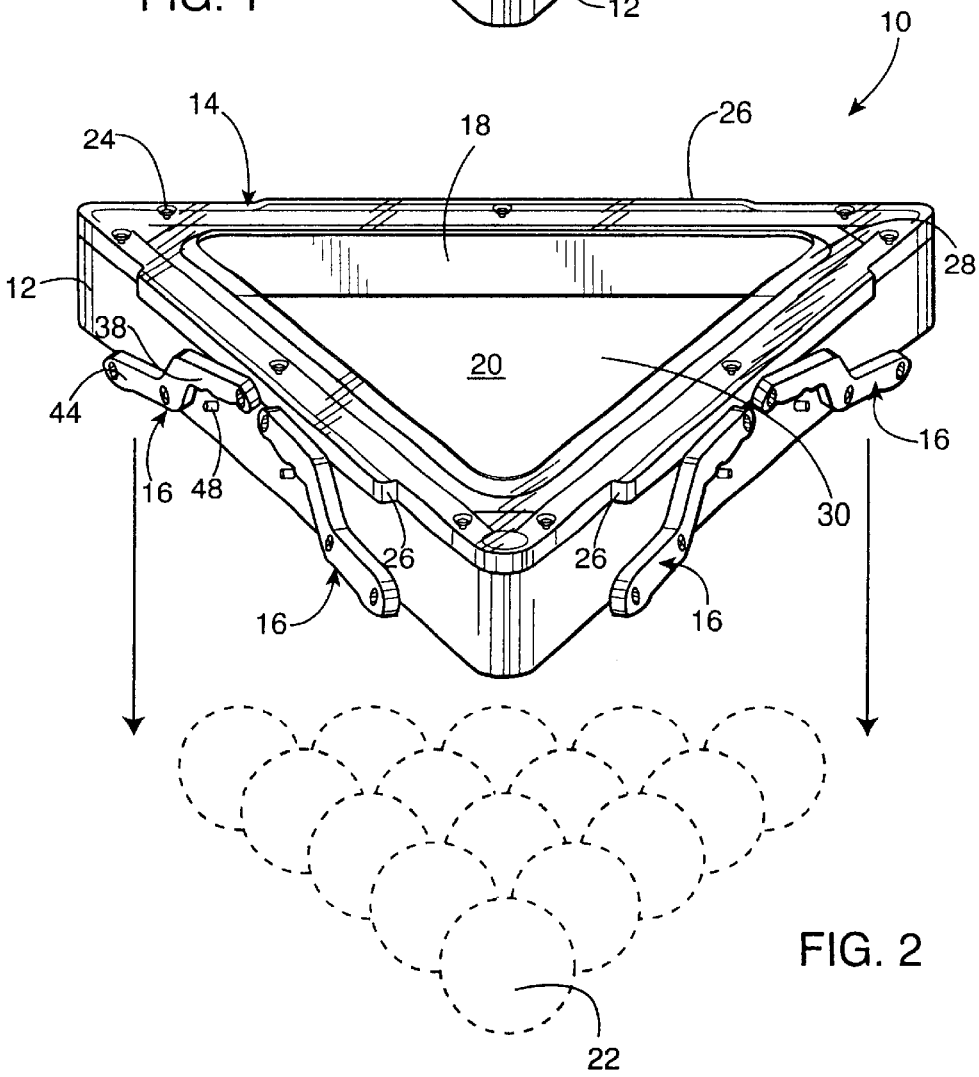
FIG. 2 is a perspective view of the billiards ball rack of FIG. 1 elevated from a playing surface, leaving the billiards balls in a desired compact configuration on the playing surface.
Figure 7:
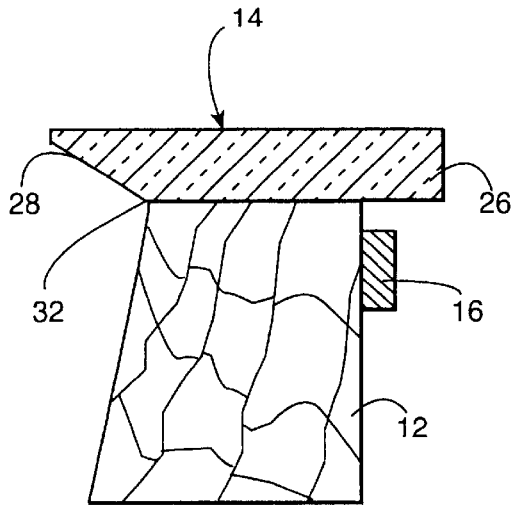
FIG. 7 is a cross-sectional view taken generally along line 7—7 of FIG. 6, illustrating an inclined surface of a plate of the rack.

Preferably, the inclined surfaces 28 define a cut-out portion 30 through which the billiards balls 22 can be placed into the enclosure 20 of the frame 12. Preferably, the plate 14 is comprised of clear plexiglass or the like to enable the user to see the billiards balls within the frame 12 through the plate 14. As illustrated in FIG. 7, the inclined surfaces 28 extend from the cut-out portion 30 and to an inner and upper edge 32 of the frame 12. The plate 14 need not include the cut-out portion 30, but instead the rack 10 can be lowered upon billiards balls 22, as illustrated in FIG. 2. However, the benefit of the cut-out portion 30 is readily apparent to those skilled in the art as it is often difficult to pre-arrange the billiards balls 22 into the desired configuration before placing the rack 10 thereon.

Figure 6:
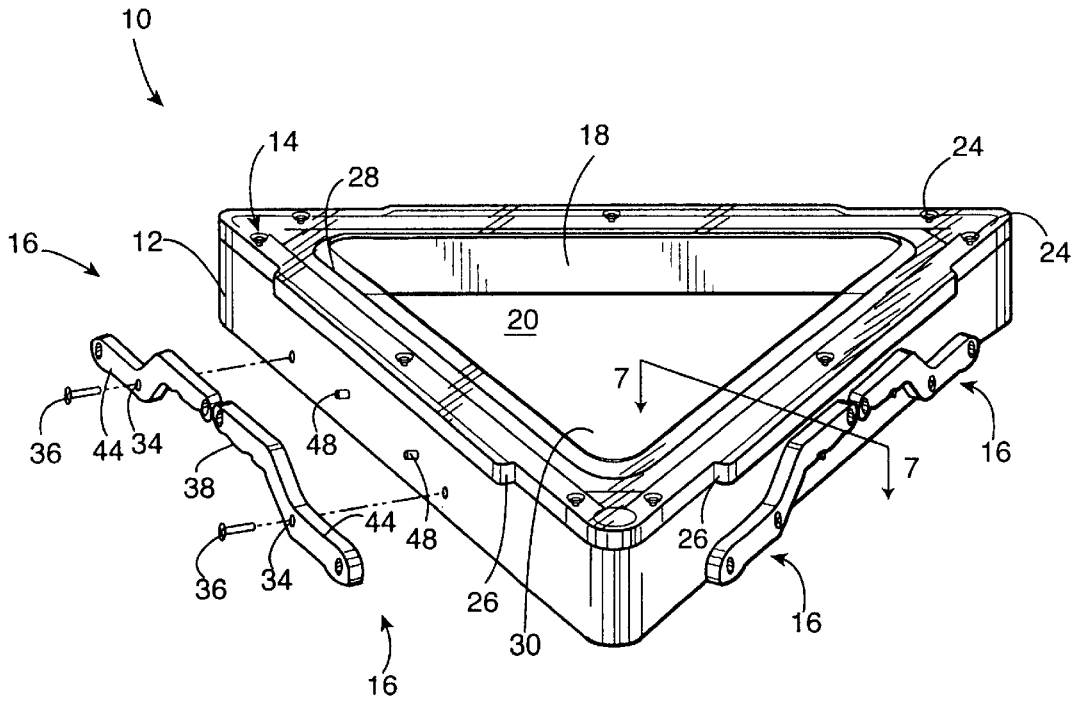
FIG. 6 is a partially exploded perspective view of the billiards ball rack embodying the present invention, illustrating the pivotal connection of levers to a side wall thereof.

With reference now to FIG. 6, on at least two side walls 18 of the frame 12 are pivotally attached levers 16. Preferably, each side wall 18 includes two levers 16 positioned generally opposite one another, as illustrated in the various figures. The levers 16 include an aperture 34 intermediate the ends thereof through which a pin 36 or the like is inserted and into the side wall 18 of the frame 12. The lever 16 is capable of pivoting about pin 36. An upper end of the lever 16 defines a handle segment 38 which lies generally parallel to the billiard table playing surface 40 when the rack 10 is resting thereon. The handle segments 38 may include finger notches 42 or the like to facilitate manual grasping thereof. A lower end of the lever 16 defines a foot segment 44. The foot segment 44 also lies generally parallel with the billiard table playing surface 40 when the rack 10 is rested thereon. The foot segment 44 may include an end 46 which is rounded or cam-like in shape to facilitate lifting.

Figure 3:
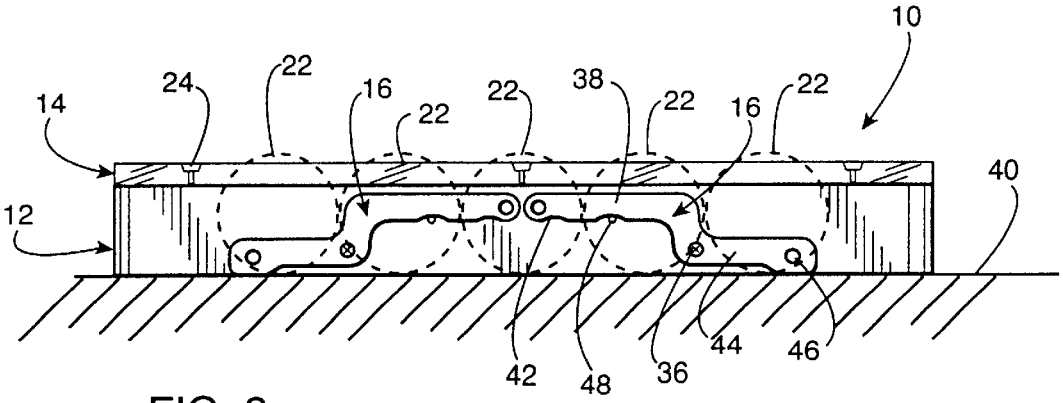
FIG. 3 is a side elevational view of the billiards ball rack of FIG. 1.
Figure 4:
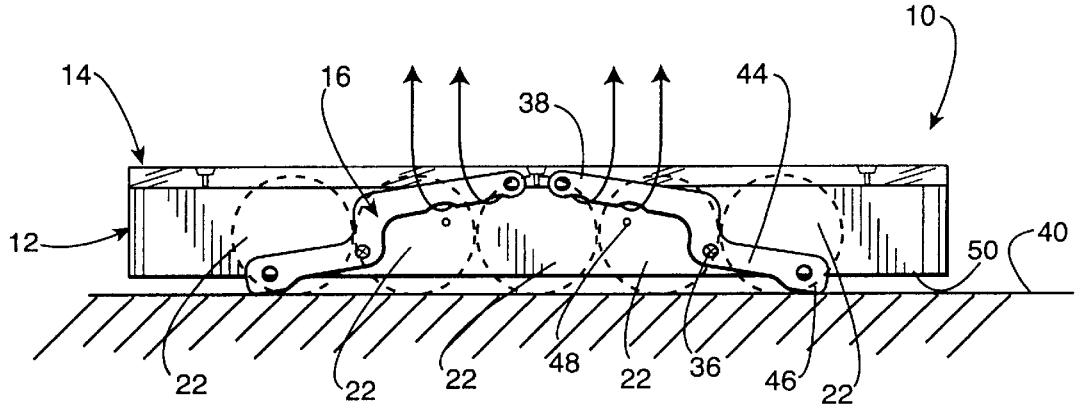
FIG. 4 is a side elevational view similar to FIG. 3, illustrating levers of the billiards ball rack being pivoted to lift the rack from the playing surface.
Figure 5:
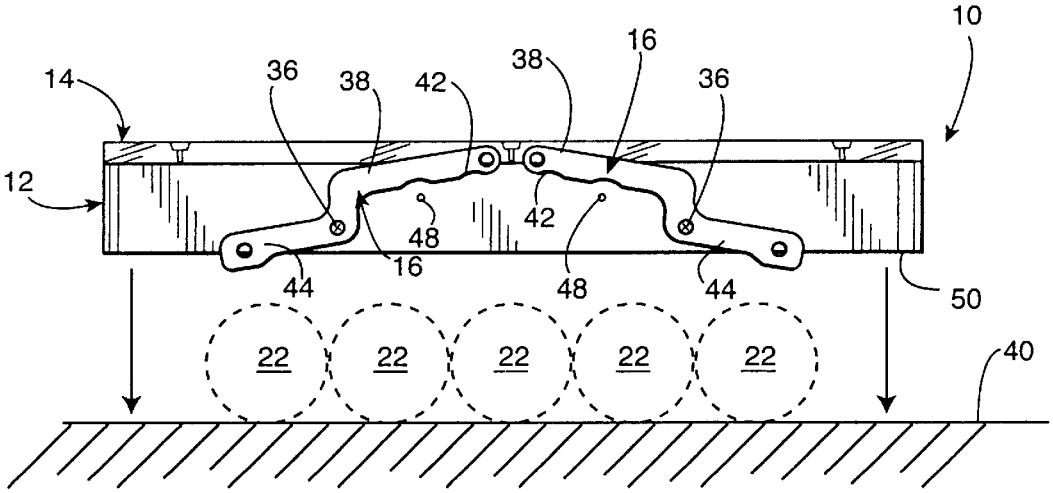
FIG. 5 is a side elevational view of the billiard rack lifted from the playing surface, with the billiards balls contained therein remaining on the playing surface in a desired configuration.

With reference now to FIGS. 3–5, in use, the rack 10 is placed at a predetermined location on the surface of the billiard table 40. The billiards balls 22 are inserted through the cut-out portion 30 and into the frame enclosure 20. The outer periphery of the billiards balls 22 engage the inclined surfaces 28 of the plate 14 as all of the billiards balls 22 are placed within the enclosure 20. The handle segments 38 of the levers 16 are grasped by the user's fingers and lifted from stops 48 built into the side wall 18 for retaining the handle segments 38 in an elevated position with respect to the playing surface of the frame base 50. As the handle segments 38 are lifted upwardly, the levers 16 pivot about pin 36, causing the foot segments 44, and particularly the rounded cam-like ends thereof 46, to contact the playing surface of the table 40 and extend below the base of the frame 50. Simultaneous lifting of the handle segments 38 on both sidewalls 18 results in a uniform lift of the rack 10 from the table playing surface, as illustrated in FIG. 4. Once the handle segments 38 contact the overhanging portions 26 of the plate 14, the entire rack 10 is lifted from the playing surface 40, as illustrated in FIG. 5. Due to the vertical motion and nonmovement of the billiards balls, the billiards balls 22 remain in the desired compact configuration on the playing surface 40. Thus, a billiards player can reproduce the desired configuration in a compact form with a great deal of consistency each time the billiards balls 22 are racked between games of play. Thus, consistent play can be achieved, without any advantage nordisadvantage to the person "breaking" the billiards ball rack.

Figure 8:
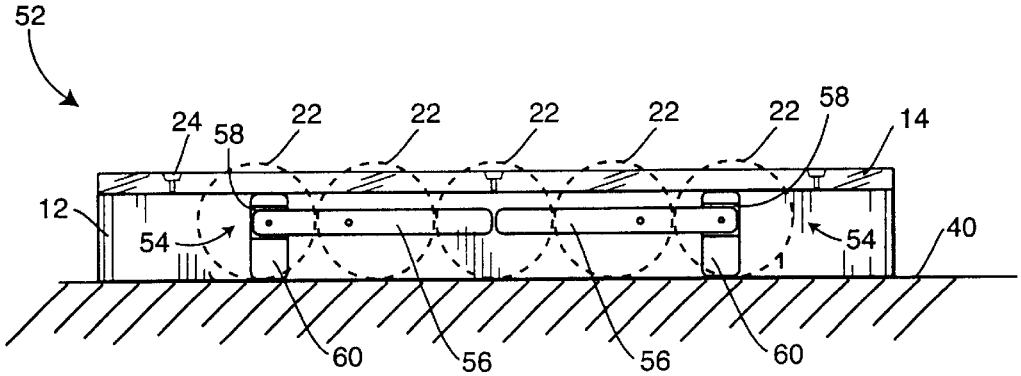
FIG. 8 is a side elevational view of a billiard rack embodying the present invention having billiards balls in phantom and illustrating levers thereof in a rested position.
Figure 9:
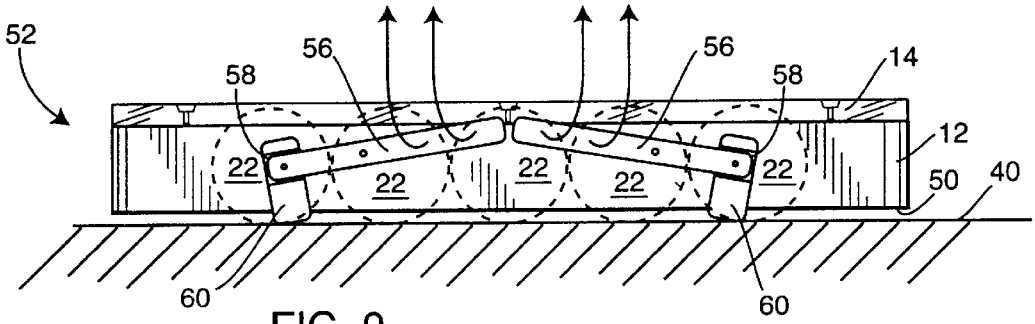
FIG. 9 is a side elevational view of the billiard rack of FIG. 8, illustrating the lifting of the levers and the billiard rack from the billiards table.

With reference now to FIGS. 8 and 9, another embodiment of the billiards ball rack 52 is illustrated having the same design and components as that described above, but having modified levers 54. The levers 54 are each comprised of a lifting bar 56 which serves as a handle and which extends into a slot 58 formed in a vertical foot member 60. The lifting bar 56 is pivotally attached to the rack frame 12 through the foot 60 using a pin or the like. Thus, as the lifting bars 56 are grasped and lifted upwardly, the lifting bar 56 pivots into contact with the foot member 60 causing the foot member 60 to pivot and a corner or lower edge thereof to descend below the base 50 of the rack 52 and push the rack 52 from the surface of the billiards table 40, as illustrated in FIG. 9.

Figure 10:
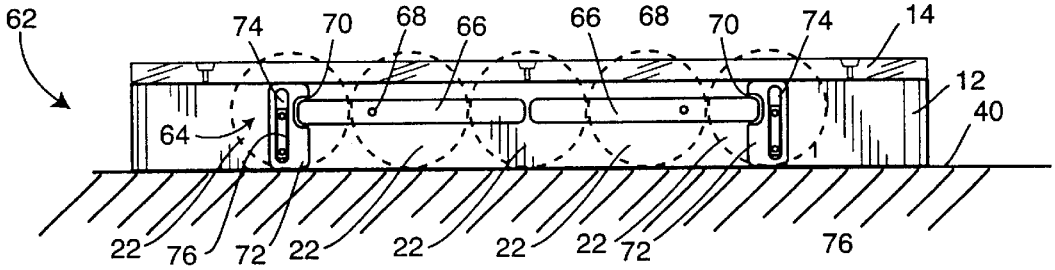
FIG. 10 is a side elevational view of a billiard rack embodying the present invention having billiards balls in phantom and illustrating levers thereof in a rested position.
Figure 11:
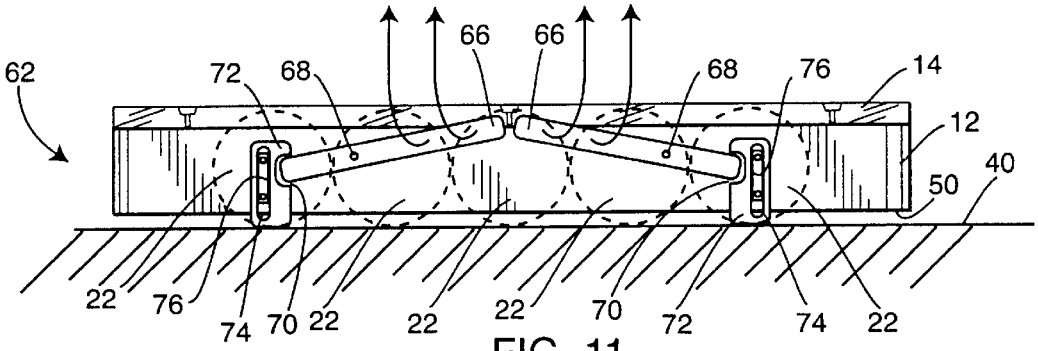
FIG. 11 is a side elevational view of the billiard rack of FIG. 8, illustrating the lifting of the levers and the billiard rack from the billiards table.

Referring now to FIGS. 10 and 11, yet another billiards ball rack 62 is shown having the same design and components as described above, but having yet another modified lever assembly 64. The levers 64 each include a lifting bar 66 pivotally attached to the frame 12 with a pin 68 or the like which creates a pivot point for the lifting bar 66. The lifting bar 66 extends into a notch 70 formed in a foot member 72. The foot member 72 includes a vertical slot 74 which accepts a vertical bar 76 or the like which is fixed or otherwise attached to the frame 12 and serves to hold the foot member 72 on the frame 12. As the lifting bar 66 is grasped and pulled upwardly, it pivots about pin 68 and applies downwardly directed pressure against foot member 72. Foot member 72 is thus pushed downwardly until the bar 76 comes into contact with the top portion of slot 74, resulting in the rack 62 being lifted from the billiards table 40. Pressing the lifting bars 66 downwardly returns the feet members 72 to their original position above or flush with the base 50 of the rack 62.

Although several embodiments of the invention have been described in detail for purposes of illustration, various modifications of each may be made without departing from the scope and spirit of the invention. Accordingly, the invention is not to be limited, except as by the appended claims.

What is claimed is:

1. A billiards ball rack, comprising;

a frame having a plurality of side walls forming an opening;

a plate attached to a top surface of the frame, the plate including inwardly and downwardly directed inclined surfaces for engaging an outer periphery of a group of billiards balls to compact them into a desired configuration on a playing surface; and lifting levers pivotally attached to two side walls of the frame, wherein the levers each include an upper handle segment and a lower foot segment, the levers being pivotally attached to the frame intermediate the handle and foot segments; and wherein the handle segment is configured to be manually grasped and pulled upward to pivot the lever, causing the foot segment to extend below a base of the frame and lift the frame from the playing surface.

2. The rack of claim 1, wherein the inclined surfaces define a cut-out portion of the plate.

3. The rack of claim 1, wherein the frame is triangular.

4. The rack of claim 3, wherein the inclined surfaces form a triangle.

5. The rack of claim 1, including a stop associated with each lever for maintaining the handle segment in an elevated position with respect to the base of the frame.

6. A billiards ball rack, comprising:

a frame having a plurality of side walls forming an opening; and a plate attached to a top surface of the frame, the plate including inwardly and downwardly directed inclined surfaces for engaging an outer periphery of a group of billiards balls to compact them into a desired configuration on a playing surface; and lifting levers pivotally attached to two side walls of the frame, wherein the levers each include an upper handle segment and a lower foot segment, the levers being pivotally attached to the frame intermediate the handle and foot segments, and wherein each side wall of the frame having a lever, includes two levers positioned generally opposite one another so that the foot segment of each lever pivots below a base of the frame an towards each other when the handle segment of each lever is manually pulled upward in order to uniformly lift the rack from the playing surface.

7. A billiards rack, comprising:

a triangular frame having a plurality of side walls forming an opening;

a plate attached to a top surface of the frame, the plate including inwardly and downwardly directed inclined surfaces defining a cut-out portion of the plate, the inclined surfaces being capable of engaging an outer periphery of a group of billiards balls to compact them into a desired configuration on a playing surface; and lifting levers pivotally attached to two side walls of the frame, wherein the levers each include an upper handle segment and a lower foot segment, the levers being pivotally attached to the frame intermediate the handle and foot segments, the handle segment being configured to be manually grasped and pulled upward to pivot the lever, causing the foot segment to extend below a base of the frame and lift the frame from the playing surface.

8. The rack of claim 7, wherein the inclined surfaces form a triangle.

9. The rack of claim 7, including a stop associated with each lever for maintaining the handle segment in an elevated position with respect to the base of the frame.

10. The rack of claim 7, wherein each side wall of the frame having a lever, includes two levers positioned generally opposite one another so that the foot segment of each lever pivots below a base of the frame and towards each other when the handle segment of each lever is manually pulled upward in order to uniformly lift the rack from the playing surface.

11. A billiards ball rack, comprising:

a triangular frame having a plurality of side walls forming an opening;

a plate attached to a top surface of the frame, the plate including inwardly and downwardly directed inclined surfaces defining a cut-out portion of the plate, the inclined surfaces being capable of engaging an outer periphery of a group of billiards balls to compact them into a desired configuration on a playing surface;

lifting levers pivotally attached to two side walls of the frame, each lever including an upper handle segment and a lower foot segment, the levers being pivotally attached to the frame intermediate the handle and foot segments, the handle segment being configured to be manually grasped and pulled upward to pivot the lever, causing the foot segment to extend below a base of the frame and lift the frame from the playing surface;

a stop associated with each lever for maintaining the handle segment in an elevated position with respect to the base of the frame.

12. The rack of claim 11, wherein the inclined surfaces form a triangle.

13. The rack of claim 11, wherein each side wall of the frame having a lever includes two levers positioned generally opposite one another so that the foot segment of each lever pivots below a base of the frame and towards each other when the handle segment of each lever is manually pulled upward in order to uniformly lift the rack from the playing surface.

* * * * *